US012594453B2

(12) United States Patent
Jiang

(10) Patent No.: US 12,594,453 B2
(45) Date of Patent: Apr. 7, 2026

(54) WEIGHT-ADJUSTABLE DUMBBELL

(71) Applicant: Duoming Zhong, Heyuan (CN)

(72) Inventor: Chun Jiang, Neijiang City (CN)

(73) Assignee: Duoming Zhong, Heyuan (CN)

( * ) Notice: Subject to any disclaimer, the term of this patent is extended or adjusted under 35 U.S.C. 154(b) by 84 days.

(21) Appl. No.: 18/633,169

(22) Filed: Apr. 11, 2024

(65) Prior Publication Data

US 2025/0010121 A1 Jan. 9, 2025

(30) Foreign Application Priority Data

Jul. 8, 2023 (CN) ..... 202321782498.2

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/0726; A63B 21/075
See application file for complete search history.

(56) References Cited

U.S. PATENT DOCUMENTS 4,453,710 A * 6/1984 Plotz ..... A63B 21/0728 403/167
4,566,690 A * 1/1986 Schook ..... A63B 21/0728 482/106
5,407,413 A * 4/1995 Kupferman ..... A63B 21/0728 482/106
6,120,420 A * 9/2000 Pearson ..... A63B 21/072 482/106
7,153,244 B2 * 12/2006 Towley, III ..... A63B 21/0728 482/108
8,790,223 B2 * 7/2014 Wang ..... A63B 21/075 482/106
8,992,396 B2 * 3/2015 Wang ..... A63B 21/0726 482/106
2003/0125169 A1 * 7/2003 Burwell ..... A63B 21/075 482/106
2014/0005012 A1 * 1/2014 Wang ..... A63B 21/0726 482/108

FOREIGN PATENT DOCUMENTS

CN 216824658 U * 6/2022
CN 217139101 U * 8/2022 ..... A63B 21/0728
CN 217828759 U * 11/2022
GB 2610854 A * 3/2023 ..... A63B 21/075

* cited by examiner

*Primary Examiner* — Joshua T Kennedy

(57) ABSTRACT

A weight-adjustable dumbbell includes a handle and counterweight block groups. The counterweight block groups include main counterweight blocks and auxiliary counterweight blocks. The main counterweight blocks are fixedly connected to two ends of the handle. One side of each auxiliary counterweight block is provided with a boss. Two ends of the boss are provided with fan-shaped convex blocks arranged correspondingly. One side of each auxiliary counterweight block away from the boss and one side of each main counterweight block away from the handle are both provided with grooves that are matched with the boss. Two sides of the grooves are provided with fan-shaped slots that are matched with the fan-shaped convex blocks. Mounting clamping slots that are matched with the fan-shaped convex blocks are arranged between inner sides of the grooves and the fan-shaped slots on the two sides.

18 Claims, 10 Drawing Sheets

WEIGHT-ADJUSTABLE DUMBBELL

CROSS-REFERENCE TO RELATED APPLICATIONS

The application claims priority of Chinese patent application CN202321782498.2, filed on Jul. 8, 2023, which is incorporated herein by reference in its entireties.

TECHNICAL FIELD

The present disclosure relates to the technical field of fitness equipment, and in particular, to a weight-adjustable dumbbell.

BACKGROUND

A dumbbell is handheld fitness equipment formed by connecting two balanced iron balls or iron blocks by a middle rod and is similar to a short-handle dumbbell. The dumbbell is usually used for muscle strength training and body shaping. Due to the widespread use of the dumbbell, a user often needs to increase or decrease the number of dumbbell pieces to adjust the weight of the dumbbell. In the existing technology, threads are generally arranged at two ends of a handle of the dumbbell. After the increase or decrease of the number of the dumbbell pieces is completed, the dumbbell pieces are fixed through a fixing nut to prevent the dumbbell pieces from falling off. This method can adjust the balance weight of the dumbbell, but it is complicated in operation and wastes time and labor.

SUMMARY

The present disclosure provides a weight-adjustable dumbbell, including:

a handle; and counterweight block groups, wherein the counterweight block groups include main counterweight blocks and auxiliary counterweight blocks; the main counterweight blocks are connected to two ends of the handle; one side of each auxiliary counterweight block is provided with a first connecting part; the main counterweight blocks are provided with first connecting fitting parts; and the first connecting parts are detachably connected to the first connecting fitting parts.

As the improvement of the present disclosure, each first connecting part is a first buckle part; each first connecting fitting part is a first buckle fitting part; and the first buckle part is detachably connected to the first buckle fitting part.

As the improvement of the present disclosure, the first buckle part is a first spinning buckle; the first buckle fitting part is a first spinning slot; the first spinning buckle is provided with a first stop convex block; the first spinning slot is provided with a first stop edge; the first stop edge is provided with a first notch; the first notch is communicated to the first spinning slot; when the first stop convex block rotates with the first spinning buckle to the first notch, the first stop convex block is able to be inserted into the first spinning slot via the first notch along with the first spinning buckle; and when the first stop convex block is inserted into the first spinning slot via the first notch along with the first spinning buckle, the first spinning buckle is rotated to enable the first stop convex block to rotate to be staggered from the first notch, causing the first stop edge to stop the first stop convex block of the first spinning buckle in the first spinning slot, so that the main counterweight block and the auxiliary counterweight block are combined to form a whole.

As the improvement of the present disclosure, the weight-adjustable dumbbell further includes a first locking device, wherein when the first spinning buckle is rotated to enable the first stop convex block to rotate to be staggered from the first notch, causing the first stop edge to stop the first stop convex block of the first spinning buckle in the first spinning slot, the first locking device locks the main counterweight block to the auxiliary counterweight block.

As the improvement of the present disclosure, the first locking device includes a first elastic locking buckle arranged on the main counterweight block and a first locking slot arranged on the auxiliary counterweight block; and when the first spinning buckle is rotated to enable the first stop convex block to rotate to be staggered from the first notch, causing the first stop edge to stop the first stop convex block of the first spinning buckle in the first spinning slot, the first elastic locking buckle is pressed and locked in the first locking slot, causing the first locking device to lock the main counterweight block to the auxiliary counterweight block.

As the improvement of the present disclosure, the other side of the auxiliary counterweight block is provided with a second connecting fitting part; the weight-adjustable dumbbell further includes a second auxiliary counterweight block; one side of the second auxiliary counterweight block is provided with a second connecting part; and the second connecting fitting part is detachably connected to the second connecting part.

As the improvement of the present disclosure, the second connecting part is a second buckle part; the second connecting fitting part is a second buckle fitting part; and the second buckle part is detachably connected to the second buckle fitting part.

As the improvement of the present disclosure, the second buckle part is a second spinning buckle; the second buckle fitting part is a second spinning slot; the second spinning buckle is provided with a second stop convex block; the second spinning slot is provided with a second stop edge; the second stop edge is provided with a second notch; the second notch is communicated to the second spinning slot; when the second stop convex block rotates with the second spinning buckle to the second notch, the second stop convex block is able to be inserted into the second spinning slot via the second notch along with the second spinning buckle; and when the second stop convex block is inserted into the second spinning slot via the second notch along with the second spinning buckle, the second spinning buckle is rotated to enable the second stop convex block to rotate to be staggered from the second notch, causing the second stop edge to stop the second stop convex block of the second spinning buckle in the second spinning slot, so that the second auxiliary counterweight block and the auxiliary counterweight block are combined to form a whole.

As the improvement of the present disclosure, the weight-adjustable dumbbell further includes a second locking device, wherein when the second spinning buckle is rotated to enable the second stop convex block to rotate to be staggered from the second notch, causing the second stop edge to stop the second stop convex block of the second spinning buckle in the second spinning slot, the second locking device locks the second auxiliary counterweight block to the auxiliary counterweight block.

As the improvement of the present disclosure, the second locking device includes a second clastic locking buckle arranged on the auxiliary counterweight block and a second locking slot arranged on the second auxiliary counterweight block; and when the second spinning buckle is rotated to enable the second stop convex block to rotate to be staggered from the second notch, causing the second stop edge to stop the second stop convex block of the second spinning buckle in the second spinning slot, the second elastic locking buckle is pressed and locked in the second locking slot, causing the second locking device to lock the second auxiliary counterweight block to the auxiliary counterweight block.

As the improvement of the present disclosure, the other side of the second auxiliary counterweight block is provided with a third connecting fitting part; the weight-adjustable dumbbell further includes a third auxiliary counterweight block; one side of the third auxiliary counterweight block is provided with a third connecting part; and the third connecting part is detachably connected to the third connecting fitting part.

As the improvement of the present disclosure, the third connecting part is a third buckle part; the third connecting fitting part is a third buckle fitting part; and the third buckle part is detachably connected to the third buckle fitting part.

As the improvement of the present disclosure, the third buckle part is a third spinning buckle; the third buckle fitting part is a third spinning slot; the third spinning buckle is provided with a third stop convex block; the third spinning slot is provided with a third stop edge; the third stop edge is provided with a third notch; the third notch is communicated to the third spinning slot; when the third stop convex block rotates with the third spinning buckle to the third notch, the third stop convex block is able to be inserted into the third spinning slot via the second notch along with the third spinning buckle; and when the third stop convex block is inserted into the third spinning slot via the third notch along with the third spinning buckle, the third spinning buckle is rotated to enable the third stop convex block to rotate to be staggered from the third notch, causing the third stop edge to stop the third stop convex block of the third spinning buckle in the third spinning slot, so that the third auxiliary counterweight block and the second auxiliary counterweight block are combined to form a whole.

As the improvement of the present disclosure, the weight-adjustable dumbbell further includes a third locking device, wherein when the third spinning buckle is rotated to enable the third stop convex block to rotate to be staggered from the third notch, causing the third stop edge to stop the third stop convex block of the third spinning buckle in the third spinning slot, the third locking device locks the third auxiliary counterweight block to the second auxiliary counterweight block.

As the improvement of the present disclosure, the third locking device includes a third clastic locking buckle arranged on the second auxiliary counterweight block and a third locking slot arranged on the third auxiliary counterweight block; and when the third spinning buckle is rotated to enable the third stop convex block to rotate to be staggered from the third notch, causing the third stop edge to stop the third stop convex block of the third spinning buckle in the third spinning slot, the third elastic locking buckle is pressed and locked in the third locking slot, causing the third locking device to lock the third auxiliary counterweight block to the second auxiliary counterweight block.

As the improvement of the present disclosure, the main counterweight block, the auxiliary counterweight block, the second counterweight block, and the third counterweight block each include a counterweight block shell and a fixed cover plate; and the counterweight block shell is internally provided with a counterweight iron plate.

As the improvement of the present disclosure, an inner side wall of the counterweight block shell is provided with a fixed clamping block, and an outer wall of the fixed cover plate is provided with a fixed clamping slot that is matched with the fixed clamping block.

As the improvement of the present disclosure, an insertion slot is arranged on one side of the fixed cover plate; the first elastic locking buckle, the second elastic locking buckle, and the third clastic locking buckle each include a positioning ball and a positioning spring; the positioning ball is slidably inserted into the insertion slot; the positioning spring is arranged in the insertion slot; and the positioning spring is connected to the positioning ball to push and lock the positioning ball to the first locking slot, the second locking slot, or the third locking slot.

The present disclosure also provides a weight-adjustable dumbbell, the weight-adjustable dumbbell includes a handle and counterweight block groups, wherein the counterweight block groups include main counterweight blocks and auxiliary counterweight blocks; the main counterweight blocks are fixedly connected to two ends of the handle; one side of each auxiliary counterweight block is provided with a boss; two ends of the boss are provided with fan-shaped convex blocks arranged correspondingly; one side of each auxiliary counterweight block away from the boss and one side of each main counterweight block away from the handle are both provided with grooves that are matched with the boss; two sides of the grooves are provided with fan-shaped slots that are matched with the fan-shaped convex blocks; and mounting clamping slots that are matched with the fan-shaped convex blocks are arranged between inner sides of the grooves and the fan-shaped slots on the two sides.

As the improvement of the present disclosure, the main counterweight blocks and the auxiliary counterweight blocks each include a counterweight block shell and a fixed cover plate; the counterweight block is internally provided with a counterweight iron plate.

As the improvement of the present disclosure, an inner side wall of the counterweight block shell is provided with a fixed clamping block, and an outer wall of the fixed cover plate is provided with a fixed clamping slot that is matched with the fixed clamping block.

As the improvement of the present disclosure, an insertion slot is arranged on one side of the fixed cover plate; a positioning ball is slidably inserted into the insertion slot; a positioning spring that is matched with the positioning ball is arranged in the insertion slot; and one side of the counterweight block shell away from the fixed cover plate is provided with a positioning slot that is matched with the positioning ball.

Compared with the existing technology, the present disclosure has the advantages that through the bosses, the fan-shaped convex blocks, the grooves, and the fan-shaped slots, during removal, the fan-shaped convex blocks on the two sides are rotated into or out of the fan-shaped slots to achieve fast removal of the auxiliary counterweight block. This saves time and labor and is convenient to operate.

DETAILED DESCRIPTION OF THE EMBODIMENTS

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

Embodiment I

Figure 6:
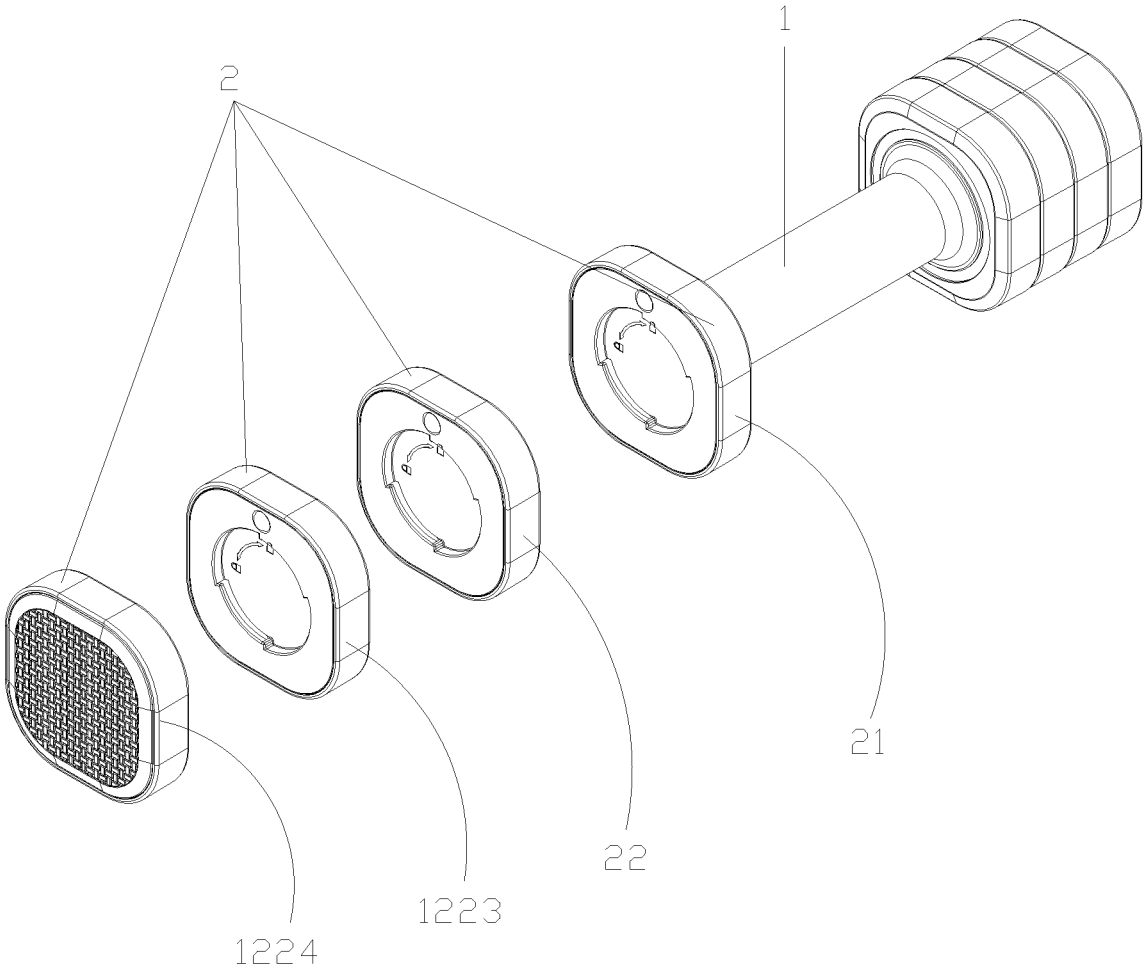
FIG. 6 is a schematic structural diagram of a weight-adjustable dumbbell in Embodiment II.
Figure 7:
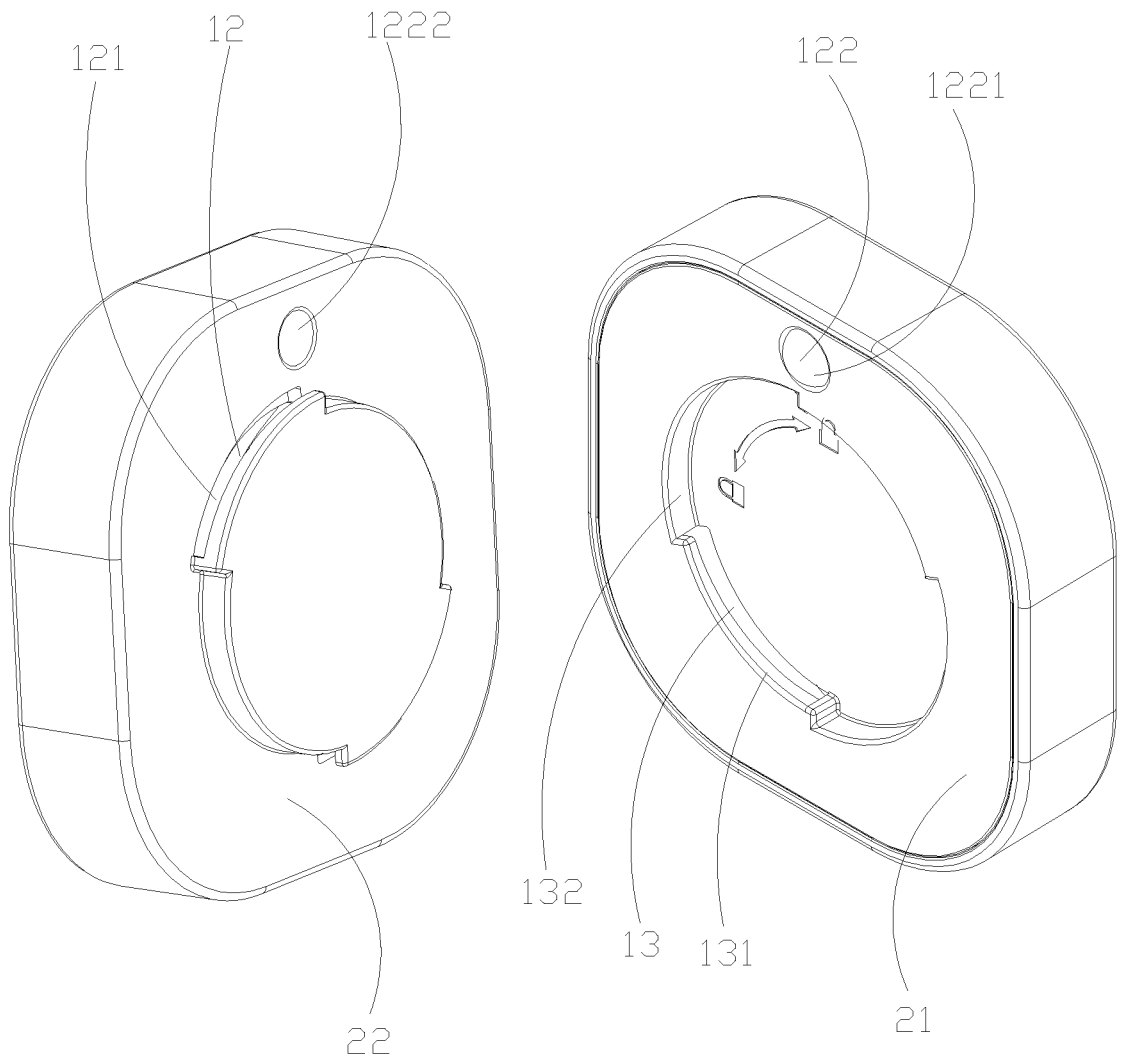
FIG. 7 is a schematic structural diagram of a main counterweight block and an auxiliary counterweight block in Embodiment II.
Figure 8:
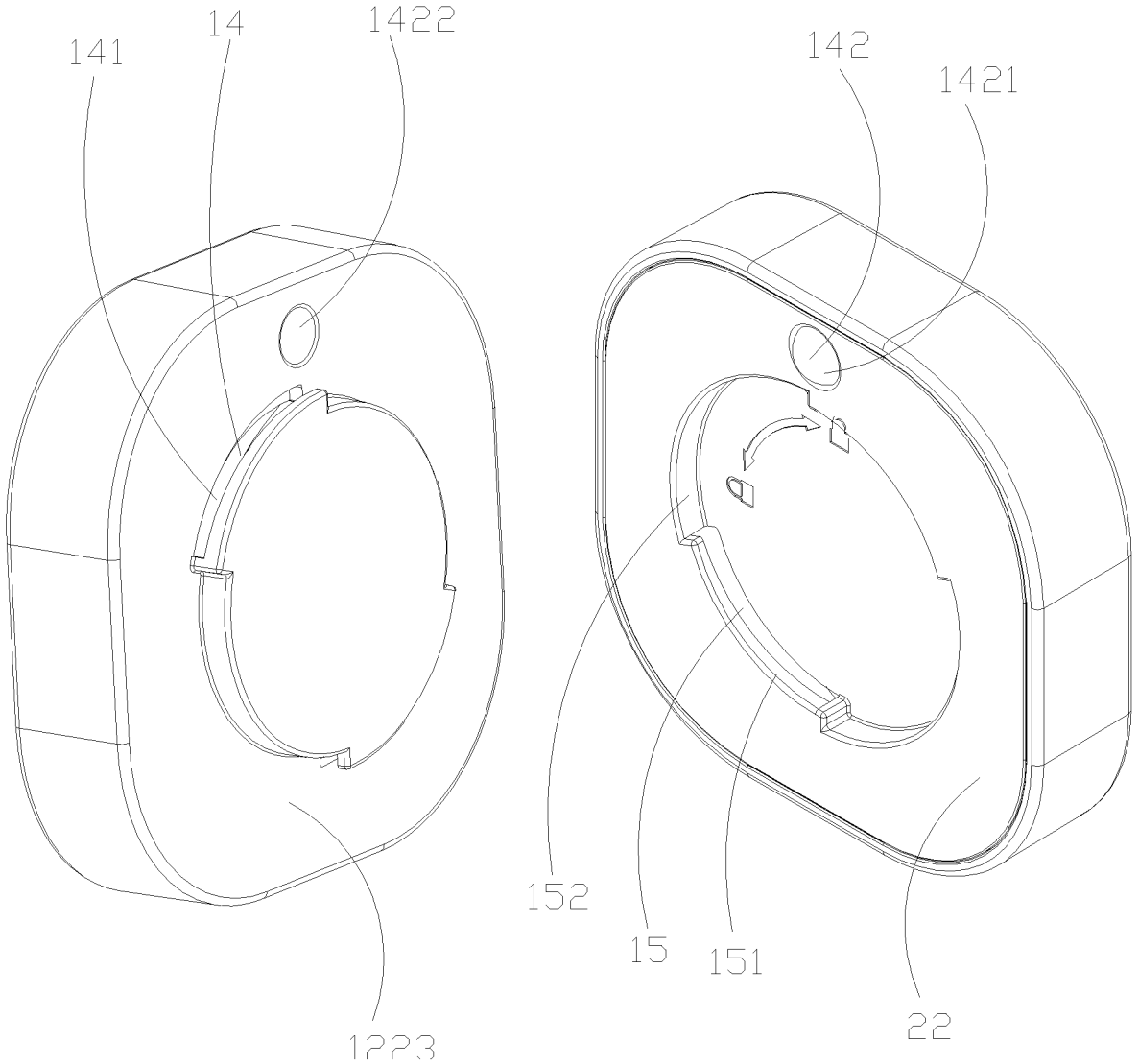
FIG. 8 is a schematic structural diagram of an auxiliary counterweight block and a second auxiliary counterweight block in Embodiment II.
Figure 9:
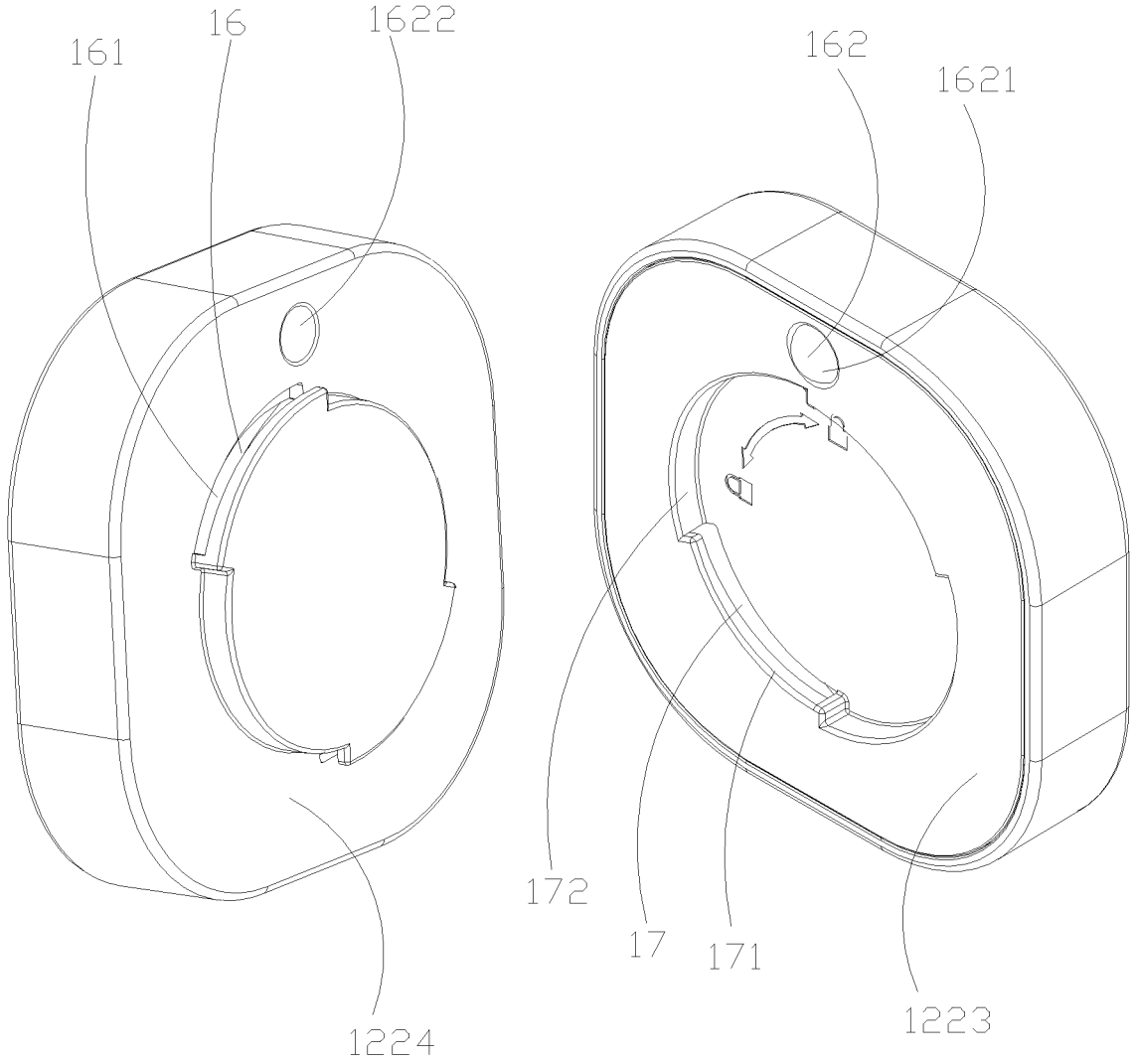
FIG. 9 is a schematic structural diagram of a second auxiliary counterweight block and a third auxiliary counterweight block in Embodiment II.
Figure 10:
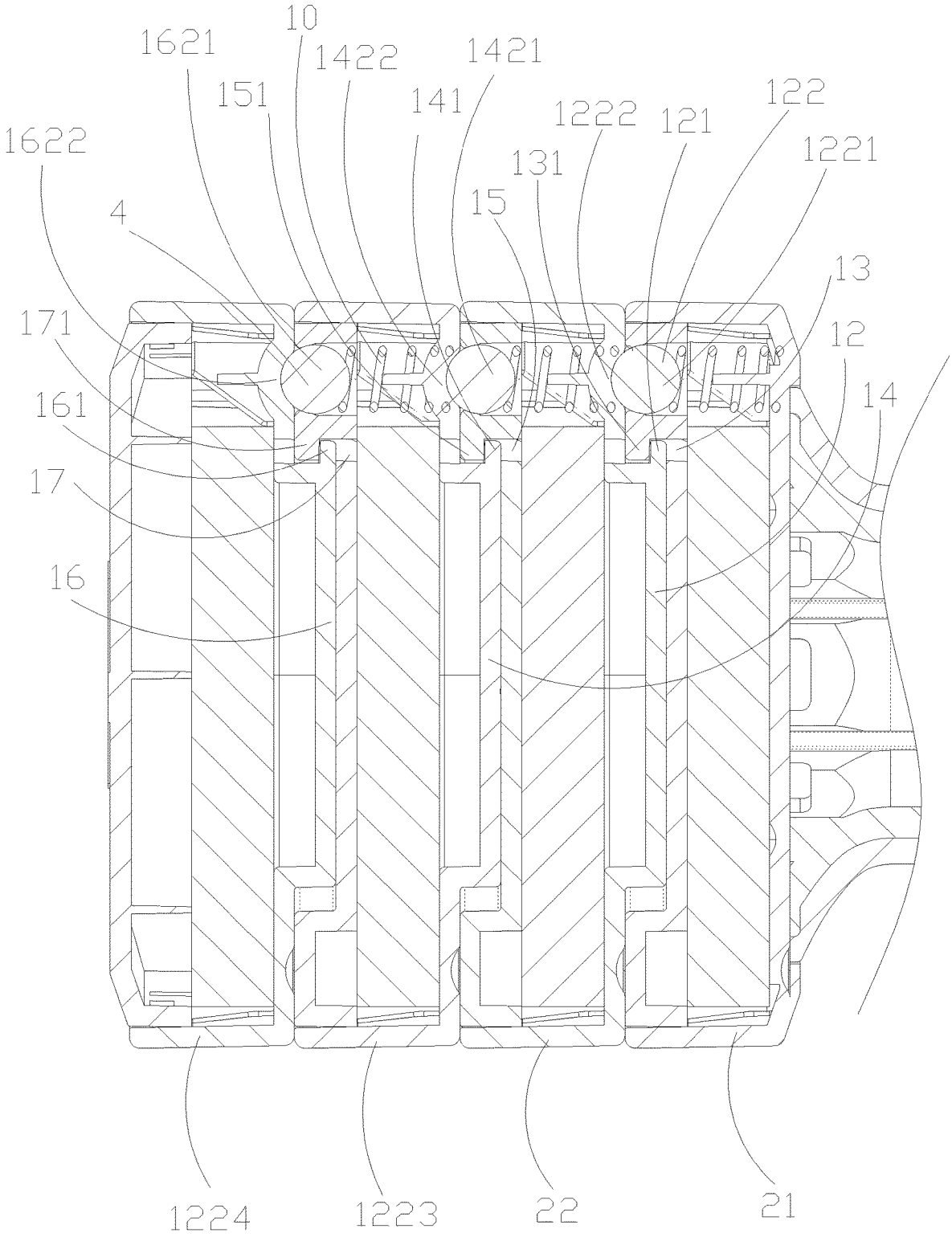
FIG. 10 is a sectional view cut along a first spinning slot, a second spinning slot, a third spinning slot, a first spinning buckle, a second spinning buckle, and a third spinning buckle in Embodiment II.

Referring to FIG. 6 to FIG. 10, a weight-adjustable dumbbell includes:

a handle 1; and counterweight block groups 2, wherein the counterweight block groups 2 include main counterweight blocks 21 and auxiliary counterweight blocks 22; the main counterweight blocks 21 are connected to two ends of the handle 1; one side of each auxiliary counterweight block 22 is provided with a first connecting part; the main counterweight blocks are provided with first connecting fitting parts; and the first connecting parts are detachably connected to the first connecting fitting parts.

Through the above structure, the weight-adjustable dumbbell includes: a handle; and counterweight block groups 2, wherein the counterweight block groups 2 include main counterweight blocks 21 and auxiliary counterweight blocks 22; the main counterweight blocks 21 are connected to two ends of the handle 1; one side of each auxiliary counterweight block 22 is provided with a first connecting part; the main counterweight blocks are provided with first connecting fitting parts; and the first connecting parts are detachably connected to the first connecting fitting parts. Therefore, a user can selectively mount the auxiliary counterweight blocks 22 to the main counterweight blocks 21 to achieve fast removal of the auxiliary counterweight blocks. This saves time and labor, is convenient to operate, and is convenient for adjusting the weight of the dumbbell.

In this embodiment, each first connecting part is a first buckle part; each first connecting fitting part is a first buckle fitting part; and the first buckle part is detachably connected to the first buckle fitting part. The first buckle part is a first spinning buckle 12; the first buckle fitting part is a first spinning slot 13; the first spinning buckle 12 is provided with a first stop convex block 121; the first spinning slot 13 is provided with a first stop edge 131; the first stop edge 131 is provided with a first notch 132; the first notch 132 is communicated to the first spinning slot 13; when the first stop convex block 121 rotates with the first spinning buckle 12 to the first notch 132, the first stop convex block 121 is able to be inserted into the first spinning slot 13 via the first notch 132 along with the first spinning buckle 12; and when the first stop convex block 121 is inserted into the first spinning slot 13 via the first notch 132 along with the first spinning buckle 12, the first spinning buckle 12 is rotated to enable the first stop convex block 121 to rotate to be staggered from the first notch 132, causing the first stop edge 131 to stop the first stop convex block 121 of the first spinning buckle 12 in the first spinning slot 13, so that the main counterweight block and the auxiliary counterweight block are combined to form a whole. Specifically, the weight-adjustable dumbbell further includes a first locking device 122; when the first spinning buckle 12 is rotated to enable the first stop convex block 121 to rotate to be staggered from the first notch 132, causing the first stop edge 131 to stop the first stop convex block 121 of the first spinning buckle 12 in the first spinning slot 13, the first locking device 122 locks the main counterweight block to the auxiliary counterweight block. Further, the first locking device 122 includes a first clastic locking buckle 1221 arranged on the main counterweight block and a first locking slot 1222 arranged on the auxiliary counterweight block; and when the first spinning buckle 12 is rotated to enable the first stop convex block 121 to rotate to be staggered from the first notch 132, causing the first stop edge 131 to stop the first stop convex block 121 of the first spinning buckle 12 in the first spinning slot 13, the first elastic locking buckle 1221 is pressed and locked in the first locking slot 1222, causing the first locking device 122 to lock the main counterweight block to the auxiliary counterweight block. Through the above structure, when the first spinning buckle is rotated into the first spinning slot, and the first stop edge 131 stop the first stop convex block 121 of the first spinning buckle 12 in the first spinning slot 13, the first elastic locking buckle is pressed and locked in the first locking slot, and the first spinning buckle is pressed to the first stop edge to tightly lock the auxiliary counterweight block to the main counterweight block. When the auxiliary counterweight block needs to be removed from the main counterweight block, a force that is greater than an elastic reset force provided by the first elastic buckle can be applied to the auxiliary counterweight block to rotate the first spinning buckle. The first spinning buckle of the auxiliary counterweight block is rotated out of the first spinning slot to remove the auxiliary counterweight block from the main counterweight block.

In this embodiment, the other side of the auxiliary counterweight block is provided with a second connecting fitting part; the weight-adjustable dumbbell further includes a second auxiliary counterweight block; one side of the second auxiliary counterweight block 1223 is provided with a second connecting part; and the second connecting fitting part is detachably connected to the second connecting part. The second connecting part is a second buckle part; the second connecting fitting part is a second buckle fitting part; and the second buckle part is detachably connected to the second buckle fitting part. Specifically, the second buckle part is a second spinning buckle 14; the second buckle fitting part is a second spinning slot 15; the second spinning buckle 14 is provided with a second stop convex block 141; the second spinning slot 15 is provided with a second stop edge 151; the second stop edge 151 is provided with a second notch 152; the second notch 152 is communicated to the second spinning slot 15; when the second stop convex block 141 rotates with the second spinning buckle 14 to the second notch 152, the second stop convex block 141 is able to be inserted into the second spinning slot 15 via the second notch 152 along with the second spinning buckle 14; and when the second stop convex block 141 is inserted into the second spinning slot 15 via the second notch 152 along with the second spinning buckle 14, the second spinning buckle 14 is rotated to enable the second stop convex block 141 to rotate to be staggered from the second notch 152, causing the second stop edge 151 to stop the second stop convex block 141 of the second spinning buckle 14 in the second spinning slot 15, so that the second auxiliary counterweight block 1223 and the auxiliary counterweight block are combined to form a whole. Further, the weight-adjustable dumbbell also includes a second locking device 142; when the second spinning buckle 14 is rotated to enable the second stop convex block 141 to rotate to be staggered from the second notch 152, causing the second stop edge 151 to stop the second stop convex block 141 of the second spinning buckle 14 in the second spinning slot 15, the second locking device 142 locks the second auxiliary counterweight block to the auxiliary counterweight block. Much further, the second locking device 142 includes a second elastic locking buckle 1421 arranged on the auxiliary counterweight block and a second locking slot 1422 arranged on the second auxiliary counterweight block; and when the second spinning buckle 14 is rotated to enable the second stop convex block 141 to rotate to be staggered from the second notch 152, causing the second stop edge 151 to stop the second stop convex block 141 of the second spinning buckle 14 in the second spinning slot 15, the second elastic locking buckle 1421 is pressed and locked in the second locking slot 1422, causing the second locking device 142 to lock the second auxiliary counterweight block 1223 to the auxiliary counterweight block. Through the above structure, when the second spinning buckle is rotated into the second spinning slot, and the second stop edge stops the second stop convex block of the second spinning buckle in the second spinning slot, the second elastic locking buckle is pressed and locked in the second locking slot, and the second spinning buckle is pressed to the second stop edge to tightly lock the second auxiliary counterweight block to the auxiliary counterweight block. When the second auxiliary counterweight block needs to be removed from the auxiliary counterweight block, a force that is greater than an clastic reset force provided by the second elastic buckle can be applied to the second auxiliary counterweight block to rotate the second spinning buckle. The second spinning buckle of the second auxiliary counterweight block is rotated out of the second spinning slot to remove the second auxiliary counterweight block from the auxiliary counterweight block.

In this embodiment, the other side of the second auxiliary counterweight block 1223 is provided with a third connecting fitting part; the weight-adjustable dumbbell further includes a third auxiliary counterweight block; one side of the third auxiliary counterweight block 1224 is provided with a third connecting part; and the third connecting part is detachably connected to the third connecting fitting part. The third connecting part is a third buckle part; the third connecting fitting part is a third buckle fitting part; and the third buckle part is detachably connected to the third buckle fitting part. Specifically, the third buckle part is a third spinning buckle 16; the third buckle fitting part is a third spinning slot 17; the third spinning buckle 16 is provided with a third stop convex block 161; the third spinning slot 17 is provided with a third stop edge 171; the third stop edge 171 is provided with a third notch 172; the third notch 172 is communicated to the third spinning slot 17; when the third stop convex block 161 rotates with the third spinning buckle 16 to the third notch 172, the third stop convex block 161 is able to be inserted into the third spinning slot 17 via the second notch 172 along with the third spinning buckle 16; and when the third stop convex block 161 is inserted into the third spinning slot 17 via the third notch 172 along with the third spinning buckle 16, the third spinning buckle 16 is rotated to enable the third stop convex block 161 to rotate to be staggered from the third notch 172, causing the third stop edge 171 to stop the third stop convex block 161 of the third spinning buckle 16 in the third spinning slot 17, so that the third auxiliary counterweight block 1224 and the second auxiliary counterweight block are combined to form a whole. Further, the weight-adjustable dumbbell also includes a third locking device 162; when the third spinning buckle 16 is rotated to enable the third stop convex block 161 to rotate to be staggered from the third notch 172, causing the third stop edge 171 to stop the third stop convex block 161 of the third spinning buckle 16 in the third spinning slot 17, the third locking device 162 locks the third auxiliary counterweight block to the second auxiliary counterweight block. Much further, the third locking device 162 includes a third clastic locking buckle 1621 arranged on the second auxiliary counterweight block and a third locking slot 1622 arranged on the third auxiliary counterweight block; and when the third spinning buckle 16 is rotated to enable the third stop convex block 161 to rotate to be staggered from the third notch 172, causing the third stop edge 171 to stop the third stop convex block 161 of the third spinning buckle 16 in the third spinning slot 17, the third elastic locking buckle 1621 is pressed and locked in the third locking slot 1622, causing the third locking device 162 to lock the third auxiliary counterweight block to the second auxiliary counterweight block. Through the above structure, when the third spinning buckle is rotated into the third spinning slot, and the third stop edge stops the third stop convex block of the third spinning buckle 16 in the third spinning slot, the third elastic locking buckle is pressed and locked in the third locking slot, and the third spinning buckle is pressed to the third stop edge to tightly lock the third auxiliary counterweight block to the second auxiliary counterweight block. When the third auxiliary counterweight block needs to be removed from the second auxiliary counterweight block, a force that is greater than an elastic reset force provided by the third clastic buckle can be applied to the third auxiliary counterweight block to rotate the third spinning buckle. The third spinning buckle of the third auxiliary counterweight block is rotated out of the third spinning slot to remove the third auxiliary counterweight block from the second auxiliary counterweight block.

In this embodiment, the main counterweight block 21, the auxiliary counterweight block 22, the second counterweight block 1223, and the third counterweight block 1224 each include a counterweight block shell 23 and a fixed cover plate 24; and the counterweight block shell 23 is internally provided with a counterweight iron plate 9. An inner side wall of the counterweight block shell 23 is provided with a fixed clamping block 7, and an outer wall of the fixed cover plate 24 is provided with a fixed clamping slot 8 that is matched with the fixed clamping block 7. Specifically, an insertion slot 6 is arranged on one side of the fixed cover plate 24; the first clastic locking buckle 1221, the second clastic locking buckle 1421, and the third elastic locking buckle 1621 each include a positioning ball and a positioning spring; the positioning ball 4 is slidably inserted into the insertion slot 6; the positioning spring 10 is arranged in the insertion slot 6; and the positioning spring 10 is connected to the positioning ball to push and lock the positioning ball to the first locking slot 1222, the second locking slot 1422, or the third locking slot 1622.

Embodiment II

Figure 1:
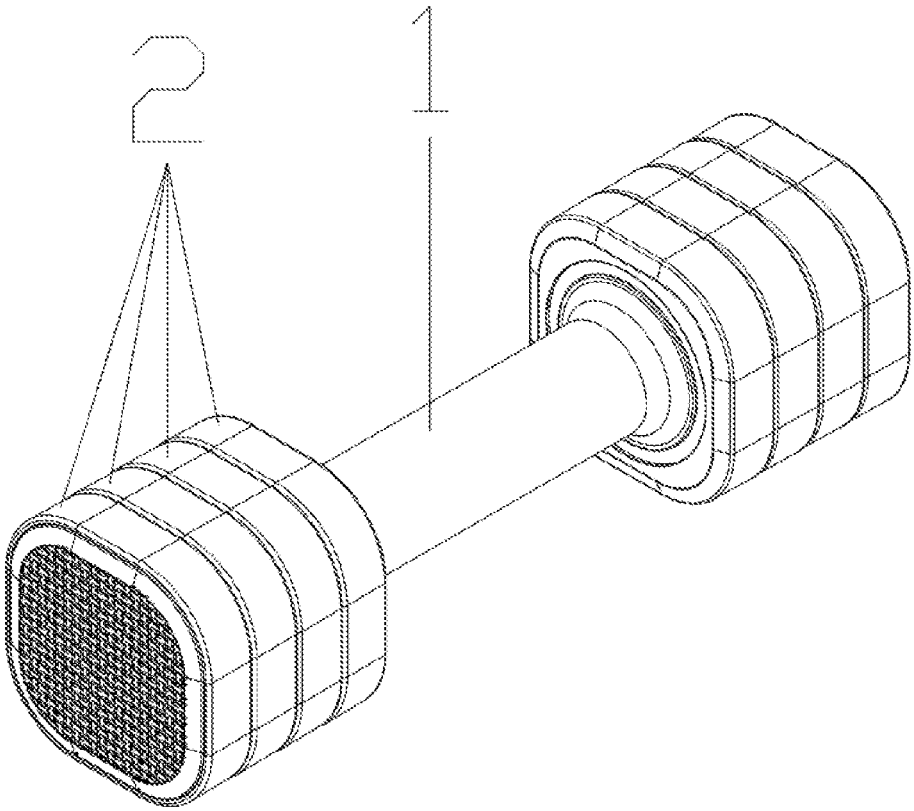
FIG. 1 is a schematic structural diagram of a weight-adjustable dumbbell in Embodiment I.
Figure 2:
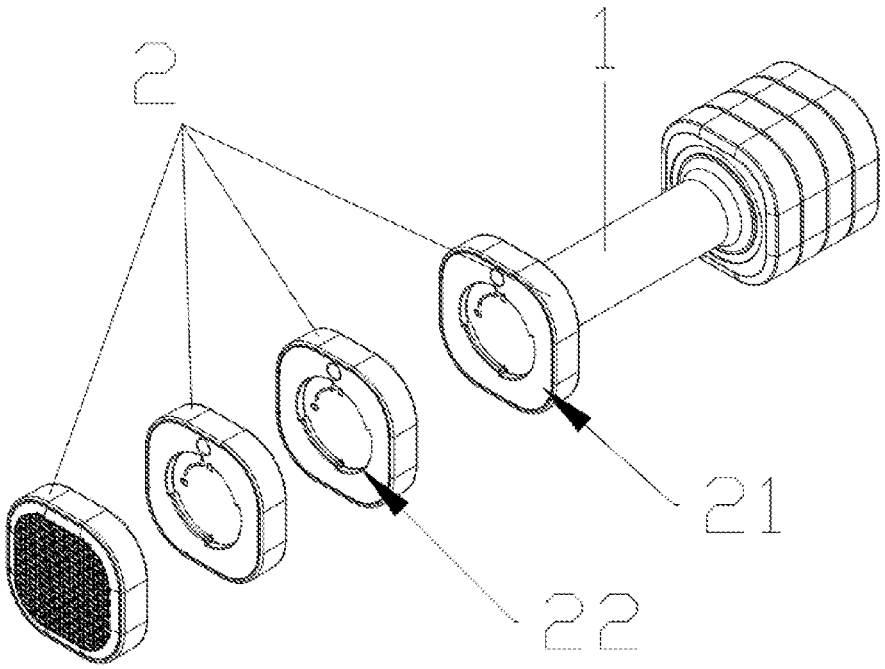
FIG. 2 is an overall exploded diagram of a weight-adjustable dumbbell in Embodiment I.
Figure 3:
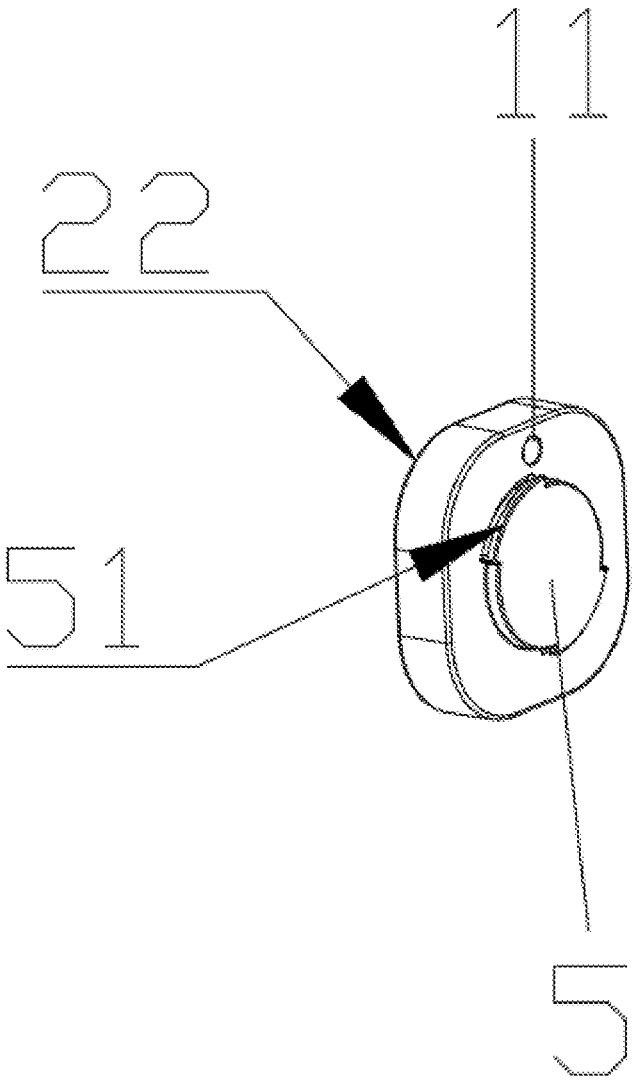
FIG. 3 is a three-dimensional diagram 1 of an auxiliary counterweight block of a weight-adjustable dumbbell in Embodiment I.
Figure 4:
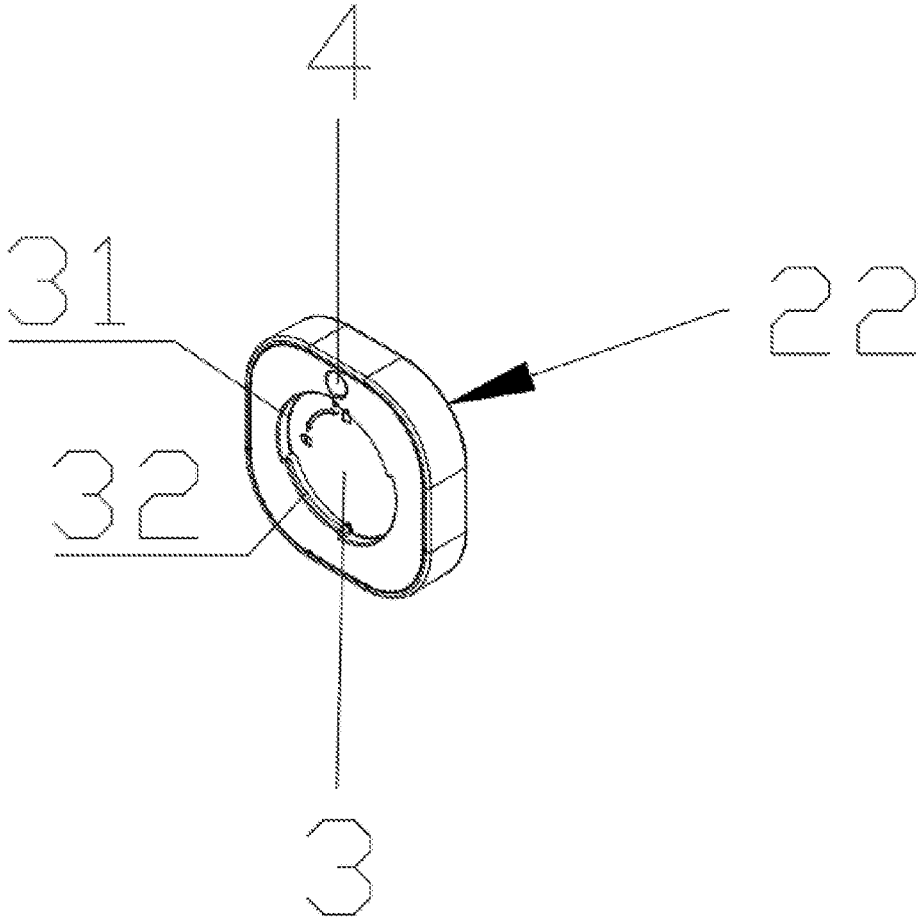
FIG. 4 is a three-dimensional diagram 2 of an auxiliary counterweight block of a weight-adjustable dumbbell in Embodiment I.
Figure 5:
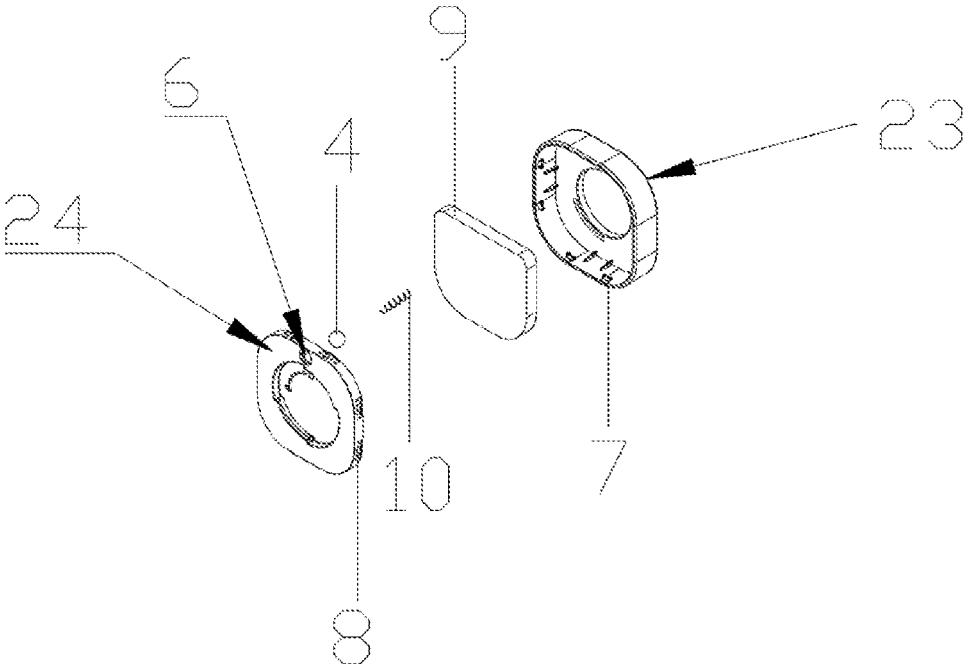
FIG. 5 is an exploded diagram of an auxiliary counterweight block of a weight-adjustable dumbbell in Embodiment I.

As shown in FIG. 1 to FIG. 5, a weight-adjustable dumbbell includes a handle 1 and counterweight block groups 2, wherein the counterweight block groups 2 include main counterweight blocks 21 and auxiliary counterweight blocks 22; the main counterweight blocks 21 and the auxiliary counterweight blocks 22 each include a counterweight block shell 23 and a fixed cover plate 24; the counterweight block shell 23 is internally provided with a counterweight iron plate 9; an inner side wall of the counterweight block shell 23 is provided with a fixed clamping block 7, and an outer wall of the fixed cover plate 24 is provided with a fixed clamping slot 8 that is matched with the fixed clamping block 7; and the main counterweight blocks 21 are fixedly connected to two ends of the handle 1.

one side of each auxiliary counterweight block 22 is provided with a boss 5; two ends of the boss 5 are provided with fan-shaped convex blocks 51 arranged correspondingly; one side of each auxiliary counterweight block 22 away from the boss 5 and one side of each main counterweight block 21 away from the handle 1 are both provided with grooves 3 that are matched with the boss 5; two sides of the grooves 3 are provided with fan-shaped slots 31 that are matched with the fan-shaped convex blocks 51; and mounting clamping slots 32 that are matched with the fan-shaped convex blocks 51 are arranged between inner sides of the grooves 3 and the fan-shaped slots 31 on the two sides.

An insertion slot 6 is arranged on one side of the fixed cover plate 24; a positioning ball 4 is slidably inserted into the insertion slot 6; a positioning spring 10 that is matched with the positioning ball 4 is arranged in the insertion slot 6; and one side of the counterweight block shell 23 away from the fixed cover plate 24 is provided with a positioning slot 11 that is matched with the positioning ball 4.

In specific use, to mount the auxiliary counterweight block 22, the boss 5 on one side of the counterweight block is inserted into the groove 3 of the corresponding counterweight block. Meanwhile, the two fan-shaped convex blocks 51 are also placed in the two fan-shaped slots 31. The auxiliary counterweight block 22 is rotated, and the auxiliary counterweight block 22 drives the boss 5 to rotate in the groove 3, so that the two fan-shaped convex blocks 51 on the two sides are inserted into the mounting clamping slots 32 on the two sides. Moreover, the positioning ball 4 rolls into the corresponding positioning slot 11 under the elastic force of the positioning spring, which further limits the counterweight block to prevent the counterweight block from being loosened. For removal, the auxiliary counterweight block 22 is rotated in an opposite direction.

It should be noted that in this document, relationship terms such as first and second are used solely to distinguish one entity or operation from another entity or operation without necessarily requiring or implying any actual such relationship or order between such entities or operations. Furthermore, the terms "include", "including", or any other variation thereof, are intended to encompass a non-exclusive inclusion, such that a process, method, article, or device that includes a list of elements does not include only those elements but may include other elements not explicitly listed or inherent to such process, method, article, or device.

Although the embodiments of the present disclosure have been shown and described, it can be understood by those of ordinary skill in the art that various changes, modifications, substitutions, and variations can be made to these embodiments without departing from the principle and spirit of the present disclosure. The scope of the present disclosure is defined by the accompanying claims and their equivalents.

The above describes the present disclosures and its implementations. Such descriptions are not restrictive. The accompanying drawings only show one of the implementations of the present disclosure, but actual structures are not limited to this. In summary, if a person of ordinary skill in the art is inspired by the present disclosure and, without deviating from the purpose of creation of the present disclosure, creatively designs structural methods and embodiments similar to the technical solution, the structural methods and embodiments shall all fall within the protection scope of the present disclosure.

What is claimed is:

1. A weight-adjustable dumbbell, comprising:

a handle; and counterweight block groups, wherein the counterweight block groups comprise main counterweight blocks and auxiliary counterweight blocks; the main counterweight blocks are connected to two ends of the handle; one side of each auxiliary counterweight block is provided with a first connecting part; the main counterweight blocks are provided with first connecting fitting parts; and the first connecting parts are detachably connected to the first connecting fitting parts;

wherein each of the main counterweight blocks and the auxiliary counterweight blocks comprises a counterweight block shell, a fixed cover plate, and a counterweight iron plate; the counterweight block shell and the fixed cover plate are fitted together to form a counterweight block cavity, the counterweight iron plate is enclosed in the counterweight block cavity;

wherein each first connecting part is a first buckle part; each first connecting fitting part is a first buckle fitting part; and the first buckle part is detachably connected to the first buckle fitting part;

wherein the first buckle part is a first spinning buckle; the first buckle fitting part is a first spinning slot; the first spinning buckle is provided with a first stop convex block; the first spinning slot is provided with a first stop edge; the first stop edge is provided with a first notch; the first notch is communicated to the first spinning slot; when the first stop convex block rotates with the first spinning buckle to the first notch, the first stop convex block is able to be inserted into the first spinning slot via the first notch along with the first spinning buckle; and when the first stop convex block is inserted into the first spinning slot via the first notch along with the first spinning buckle, the first spinning buckle is rotated to enable the first stop convex block to rotate to be staggered from the first notch, causing the first stop edge to stop the first stop convex block of the first spinning buckle in the first spinning slot, so that the main counterweight block and the auxiliary counterweight block are combined to form a whole.

2. The weight-adjustable dumbbell according to claim 1, further comprising a first locking device, wherein when the first spinning buckle is rotated to enable the first stop convex block to rotate to be staggered from the first notch, causing the first stop edge to stop the first stop convex block of the first spinning buckle in the first spinning slot, the first locking device locks the main counterweight block to the auxiliary counterweight block.

3. The weight-adjustable dumbbell according to claim 2, wherein the first locking device comprises a first elastic locking buckle arranged on the main counterweight block and a first locking slot arranged on the auxiliary counterweight block; and when the first spinning buckle is rotated to enable the first stop convex block to rotate to be staggered from the first notch, causing the first stop edge to stop the first stop convex block of the first spinning buckle in the first spinning slot, the first elastic locking buckle is pressed and locked in the first locking slot, causing the first locking device to lock the main counterweight block to the auxiliary counterweight block.

4. The weight-adjustable dumbbell according to claim 3, wherein the other side of the auxiliary counterweight block is provided with a second connecting fitting part; the weight-adjustable dumbbell further comprises a second auxiliary counterweight block; one side of the second auxiliary counterweight block is provided with a second connecting part; and the second connecting fitting part is detachably connected to the second connecting part.

5. The weight-adjustable dumbbell according to claim 4, wherein the second connecting part is a second buckle part; the second connecting fitting part is a second buckle fitting part; and the second buckle part is detachably connected to the second buckle fitting part.

6. The weight-adjustable dumbbell according to claim 5, wherein the second buckle part is a second spinning buckle; the second buckle fitting part is a second spinning slot; the second spinning buckle is provided with a second stop convex block; the second spinning slot is provided with a second stop edge; the second stop edge is provided with a second notch; the second notch is communicated to the second spinning slot; when the second stop convex block rotates with the second spinning buckle to the second notch, the second stop convex block is able to be inserted into the second spinning slot via the second notch along with the second spinning buckle; and when the second stop convex block is inserted into the second spinning slot via the second notch along with the second spinning buckle, the second spinning buckle is rotated to enable the second stop convex block to rotate to be staggered from the second notch, causing the second stop edge to stop the second stop convex block of the second spinning buckle in the second spinning slot, so that the second auxiliary counterweight block and the auxiliary counterweight block are combined to form a whole.

7. The weight-adjustable dumbbell according to claim 6, further comprising a second locking device, wherein when the second spinning buckle is rotated to enable the second stop convex block to rotate to be staggered from the second notch, causing the second stop edge to stop the second stop convex block of the second spinning buckle in the second spinning slot, the second locking device locks the second auxiliary counterweight block to the auxiliary counterweight block.

8. The weight-adjustable dumbbell according to claim 7, wherein the second locking device comprises a second elastic locking buckle arranged on the auxiliary counterweight block and a second locking slot arranged on the second auxiliary counterweight block; and when the second spinning buckle is rotated to enable the second stop convex block to rotate to be staggered from the second notch, causing the second stop edge to stop the second stop convex block of the second spinning buckle in the second spinning slot, the second elastic locking buckle is pressed and locked in the second locking slot, causing the second locking device to lock the second auxiliary counterweight block to the auxiliary counterweight block.

9. The weight-adjustable dumbbell according to claim 8, wherein the other side of the second auxiliary counterweight block is provided with a third connecting fitting part; the weight-adjustable dumbbell further comprises a third auxiliary counterweight block; one side of the third auxiliary counterweight block is provided with a third connecting part; and the third connecting part is detachably connected to the third connecting fitting part.

10. The weight-adjustable dumbbell according to claim 9, wherein the third connecting part is a third buckle part; the third connecting fitting part is a third buckle fitting part; and the third buckle part is detachably connected to the third buckle fitting part.

11. The weight-adjustable dumbbell according to claim 10, wherein the third buckle part is a third spinning buckle; the third buckle fitting part is a third spinning slot; the third spinning buckle is provided with a third stop convex block; the third spinning slot is provided with a third stop edge; the third stop edge is provided with a third notch; the third notch is communicated to the third spinning slot; when the third stop convex block rotates with the third spinning buckle to the third notch, the third stop convex block is able to be inserted into the third spinning slot via the second notch along with the third spinning buckle; and when the third stop convex block is inserted into the third spinning slot via the third notch along with the third spinning buckle, the third spinning buckle is rotated to enable the third stop convex block to rotate to be staggered from the third notch, causing the third stop edge to stop the third stop convex block of the third spinning buckle in the third spinning slot, so that the third auxiliary counterweight block and the second auxiliary counterweight block are combined to form a whole.

12. The weight-adjustable dumbbell according to claim 11, further comprising a third locking device, wherein when the third spinning buckle is rotated to enable the third stop convex block to rotate to be staggered from the third notch, causing the third stop edge to stop the third stop convex block of the third spinning buckle in the third spinning slot, the third locking device locks the third auxiliary counterweight block to the second auxiliary counterweight block.

13. The weight-adjustable dumbbell according to claim 12, wherein the third locking device comprises a third elastic locking buckle arranged on the second auxiliary counterweight block and a third locking slot arranged on the third auxiliary counterweight block; and when the third spinning buckle is rotated to enable the third stop convex block to rotate to be staggered from the third notch, causing the third stop edge to stop the third stop convex block of the third spinning buckle in the third spinning slot, the third elastic locking buckle is pressed and locked in the third locking slot, causing the third locking device to lock the third auxiliary counterweight block to the second auxiliary counterweight block.

14. The weight-adjustable dumbbell according to claim 13, wherein the second auxiliary counterweight block and the third auxiliary counterweight block each also comprises a counterweight block shell, a fixed cover plate, and a counterweight iron plate; the counterweight block shell and the fixed cover plate are fitted together to form a counterweight block cavity, the counterweight iron plate is enclosed in the counterweight block cavity.

15. The weight-adjustable dumbbell according to claim 14, wherein an inner side wall of the counterweight block shell is provided with a fixed clamping block, and an outer wall of the fixed cover plate is provided with a fixed clamping slot that is matched with the fixed clamping block.

16. The weight-adjustable dumbbell according to claim 15, wherein an insertion slot is arranged on one side of the fixed cover plate of each of the main counterweight block, the auxiliary counterweight block, and the second auxiliary counterweight block; the first elastic locking buckle, the second elastic locking buckle, and the third elastic locking buckle each comprise a positioning ball and a positioning spring; the positioning ball is slidably inserted into the insertion slot; the positioning spring is arranged in the insertion slot; and the positioning spring is connected to the positioning ball to push and lock the positioning ball to the first locking slot, the second locking slot, or the third locking slot; the fixed cover plate of the third auxiliary counterweight block is provided with no insertion slot.

17. A weight-adjustable dumbbell, comprising a handle and counterweight block groups, wherein the counterweight block groups comprise main counterweight blocks and auxiliary counterweight blocks; the main counterweight blocks are fixedly connected to two ends of the handle; one side of each auxiliary counterweight block is provided with a boss; two ends of the boss are provided with fan-shaped convex blocks arranged correspondingly; one side of each auxiliary counterweight block away from the boss and one side of each main counterweight block away from the handle are both provided with grooves that are matched with the boss; two sides of the grooves are provided with fan-shaped slots that are matched with the fan-shaped convex blocks; and mounting clamping slots that are matched with the fan-shaped convex blocks are arranged between inner sides of the grooves and the fan-shaped slots on the two sides;

wherein each of the main counterweight blocks and the auxiliary counterweight blocks comprises a counterweight block shell, a fixed cover plate, and a counterweight iron plate; the counterweight block shell and the fixed cover plate are fitted together to form a counterweight block cavity, the counterweight iron plate is enclosed in the counterweight block cavity.

18. The weight-adjustable dumbbell according to claim 17, wherein an inner side wall of the counterweight block shell is provided with a fixed clamping block, and an outer wall of the fixed cover plate is provided with a fixed clamping slot that is matched with the fixed clamping block; an insertion slot is arranged on one side of the fixed cover plate of each of the main counterweight blocks and the auxiliary counterweight blocks except the outermost auxiliary counterweight block; a positioning ball is slidably inserted into the insertion slot; a positioning spring that is matched with the positioning ball is arranged in the insertion slot; and one side of the counterweight block shell away from the fixed cover plate is provided with a positioning slot that is matched with the positioning ball.

* * * * *